US010693244B2

(12) United States Patent
Zimmerman et al.

(10) Patent No.: US 10,693,244 B2
(45) **Date of Patent: *Jun. 23, 2020**

(54) INDEPENDENT AZIMUTH PATTERNS FOR SHARED APERTURE ARRAY ANTENNA

(71) Applicant: CommScope Technologies LLC, Hickory, NC (US)

(72) Inventors: Martin Lee Zimmerman, Chicago, IL (US); LiShao Cai, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/039,361

(22) Filed: Jul. 19, 2018

(65) Prior Publication Data

US 2018/0323516 A1 Nov. 8, 2018

Related U.S. Application Data

(63) Continuation of application No. 15/645,537, filed on Jul. 10, 2017, now Pat. No. 10,050,354, which is a (Continued)

(30) Foreign Application Priority Data

Feb. 28, 2015 (WO) ..... PCT/CN2015/073386

(51) Int. Cl.
*H01Q 21/30* (2006.01)
*H01Q 3/26* (2006.01)
(Continued)

(52) U.S. Cl.
CPC ..... *H01Q 21/30* (2013.01); *H01Q 1/246* (2013.01); *H01Q 3/26* (2013.01);
(Continued)

(58) Field of Classification Search
CPC ..... H01Q 21/30; H01Q 21/28; H01Q 3/26; H01Q 21/00
(Continued)

(56) References Cited

U.S. PATENT DOCUMENTS 4,689,627 A 8/1987 Lee et al.
4,799,065 A 1/1989 Thompson
(Continued)

FOREIGN PATENT DOCUMENTS

CN 101232127 A 7/2008
CN 201130715 Y 10/2008
(Continued)

OTHER PUBLICATIONS

Zhi Ning Chen et al.: "Antennas for Base Stations in Wireless Communications" In: "Antennas for Base Stations", Jan. 1, 2009, McGraw Hill, New York, XP055428973, ISBN: 978-0-07-161289-0 pp. i-348, *chapter 2.3; p. 44-p. 94* *chapters 7.2.2-7.5; p. 249-p. 289*
(Continued)

*Primary Examiner* — Huedung X Mancuso
(74) *Attorney, Agent, or Firm* — Myers Bigel, P.A.

(57) ABSTRACT

A multi-column antenna having ports for different sub-bands is provided. In one aspect of the invention, power dividers couple the sub-band ports to the columns of radiating elements. At least one power divider is an un-equal power divider to allow a half-power beam width (HPBW) of one sub-band to be configured independently of the HPBW of the other sub-band. The ports may be combined at the radiating elements by diplexers. According to another aspect of the present invention, a multi-column antenna has a plurality of first sub-band ports and a plurality of second sub-band ports. Each of the first sub-band ports is coupled to one of the columns by a first sub-band feed network. Each
(Continued)

of the second sub-band ports is coupled to two of the columns by a second sub-band feed network including a power divider. The different sub-bands have different MIMO optimization of the same multi-column antenna.

17 Claims, 6 Drawing Sheets

Related U.S. Application Data continuation of application No. 14/668,441, filed on Mar. 25, 2015, now Pat. No. 9,722,327.

(60) Provisional application No. 62/008,227, filed on Jun. 5, 2014.

(51) Int. Cl.

| | |
|---|---|
| ***H01Q 21/28*** | (2006.01) |
| ***H01Q 1/24*** | (2006.01) |
| ***H01Q 21/06*** | (2006.01) |
| ***H01Q 21/22*** | (2006.01) |
| ***H01Q 21/29*** | (2006.01) |
| ***H01Q 21/00*** | (2006.01) |

(52) U.S. Cl.
CPC ..... *H01Q 21/0006* (2013.01); *H01Q 21/06* (2013.01); *H01Q 21/22* (2013.01); *H01Q 21/28* (2013.01); *H01Q 21/293* (2013.01)

(58) Field of Classification Search
USPC ..... 343/853
See application file for complete search history.

(56) References Cited

U.S. PATENT DOCUMENTS

| | | | | |
|---|---|---|---|---|
| 5,150,083 | A | 9/1992 | Chen et al. | |
| 6,163,564 | A | 12/2000 | Rudish et al. | |
| 6,850,130 | B1 | 2/2005 | Gottl et al. | |
| 6,864,837 | B2 | 3/2005 | Runyon et al. | |
| 7,579,995 | B1 * | 8/2009 | Theunissen | H01Q 3/2611 343/741 |
| 8,345,639 | B2 | 1/2013 | Hensley et al. | |
| 9,107,082 | B2 | 8/2015 | Andersson et al. | |
| 9,325,065 | B2 | 4/2016 | Veihl et al. | |
| 2012/0063525 | A1 | 3/2012 | Engstroem et al. | |
| 2012/0194406 | A1 | 8/2012 | Brown et al. | |
| 2012/0280879 | A1 * | 11/2012 | Zimmerman | H01Q 1/246 343/798 |
| 2013/0235806 | A1 | 9/2013 | Nilsson et al. | |
| 2013/0244594 | A1 * | 9/2013 | Alrabadi | H04B 7/0413 455/78 |
| 2013/0281159 | A1 | 10/2013 | Al et al. | |
| 2014/0062834 | A1 * | 3/2014 | Jidhage | H01Q 1/246 343/893 |
| 2015/0098495 | A1 | 4/2015 | He et al. | |
| 2016/0248158 | A1 | 8/2016 | So et al. | |

FOREIGN PATENT DOCUMENTS

| | | | |
|---|---|---|---|
| CN | 101356747 | A | 1/2009 |
| CN | 102113171 | A | 6/2011 |
| CN | 103201900 | A | 7/2013 |
| CN | 103311669 | A | 9/2013 |
| CN | 103563170 | A | 2/2014 |
| CN | 103812541 | A | 5/2014 |
| DE | 10034911 | | 2/2002 |
| WO | 01/13459 | | 2/2001 |
| WO | WO0207254 | A1 | 1/2002 |

OTHER PUBLICATIONS

European Office Action corresponding to European Application No. 15804027.9 (12 pages) (Jan. 25, 2019).

Chinese Office Action corresponding to Chinese Application No. 201580030919.8, dated Nov. 27, 2018, (Translation Only).

* cited by examiner

60

INDEPENDENT AZIMUTH PATTERNS FOR SHARED APERTURE ARRAY ANTENNA

CROSS-REFERENCE TO PRIORITY APPLICATIONS

This application is a continuation of U.S. patent application Ser. No. 15/645,537, filed Jul. 10, 2017, which, in turn, is a continuation of U.S. patent application Ser. No. 14/668,441, filed Mar. 25, 2015, entitled "Independent Azimuth Patterns for Shared Aperture Array Antenna", now U.S. Pat. No. 9,722,327, which claims priority to U.S. Provisional Patent Application No. 62/008,227, filed Jun. 5, 2014 and International Application No. PCT/CN2015/073386, which has an international filing date of Feb. 28, 2015, the disclosures of which are hereby incorporated herein by reference.

BACKGROUND

Cellular Base Station Antennas typically contain one or more columns of radiating elements connected by a power distribution feed network. This feed network contains power dividers that split the input power between groups of radiating elements or sub-arrays of radiating elements. The feed network also is designed to generate specific phase values at each radiating element or sub-array of radiating elements. This feed network may also contain a phase shifter which allows the phases for each radiating element or sub-array of radiating elements to be adjusted so as to adjust the beam peak position of the main beam of the antenna pattern.

One standard for wireless communication of high-speed data for mobile phones and data terminals is known as Long-Term Evolution, commonly abbreviated as LTE and marketed as 4G LTE. The LTE standard supports both Frequency Division Duplexing (FDD-LTE) and Time Division Duplexing (TDD-LTE) technologies in different sub-bands. For example the 2490-2690 MHz band is licensed world-wide for TDD-LTE. In many of these same countries, bands such as 1710-1880, 1850-1990, 1920-2170 and 1710-2155 MHz are used for FDD-LTE applications.

Ultra-wideband radiating elements than operate in a band of 1710 MHz to 2690 MHz are available. However, different Multiple Input Multiple Output (MIMO) configurations are encouraged for use in the different sub-bands. Many TDD-LTE networks make use of multi-column beamforming antennas. An antenna optimized for TDD-LTE may include 4 columns of radiators spaced 0.5-0.65 wavelength apart and each generating a nominal column Half Power Beamwidth (HPBW) of about 65 to 90 degrees in the 2490-2690 MHz band. This results in a 4×1 MIMO antenna. In contrast, in FDD-LTE applications, 2×1 MIMO is encouraged, using 2 columns of radiators with a nominal 45-65 degree HPBW and a column spacing of about one wavelength. Due to these different requirements concerning the number of MIMO ports and column spacing, 4×1 MIMO and 2×1 MIMO are typically implemented in separate antennas.

Attempts to combine sub-bands in common radiating element arrays are known. For example, using broadband radiating elements and then placing multiplexer filters (e.g. diplexers, triplexers) between the radiating elements and the rest of the feed network in order to allow multiple narrower band frequency-specific feed networks to be attached to the same array of radiating elements is disclosed in U.S. Pat. No. 9,325,065, which is incorporated by reference herein. This sharing of radiating elements allows, for example, a single column of radiating elements to generate patterns with independent elevation downtilts for two different frequency bands. This concept in principle may be extended to antennas with multiple columns of radiating elements. However, in practice, if the number of columns and column spacing are optimized for one sub-band of LTE, number of columns and column spacing will not be optimized for the other sub-bands of LTE. For example, a design that is optimized for the FDD-LTE 1900 MHz sub-band (two columns at about one wavelength apart) results in a sub-optimal configuration for the TDD-LTE sub-band (2 columns at about 1.3 wavelength separation, where four columns at 0.65 wavelength is desired).

Azimuth pattern variation is another issue that exists with respect to ultra-wideband antennas. For example in the wireless communications market there is a need for an antenna that generates independent patterns in the 1710-2170 MHz and 2490-2690 MHz bands. Radiating elements covering the entire 1710-2690 MHz band are known. However since 1710-2690 MHz is a 42% band (i.e., the width of the band is 42% of the midpoint of the band), a multi-column array generating a narrow HPBW of, for example 33 to 45 degrees, will experience 42% variation in azimuth HPBW across this band. This amount of variation is unacceptable for many applications.

SUMMARY

According to one aspect of the invention, an antenna, including at least two columns of radiating elements is provided. A first port corresponding to a first sub-band is coupled to a first power divider, wherein first and second outputs of the power divider are coupled to the two columns of radiating elements. A second port corresponding to a second sub-band is coupled to a second power divider, wherein first and second outputs of the second power divider are also coupled to the two column of radiating elements. The first power divider has a first power division ratio and the second power divider has a second power division ratio which is different from the first power division ratio.

In one example, the first power division ratio is 1:2 and the second power division ratio is not 1:2, i.e., the second first power divider comprises an un-equal power divider. This allows the half-power beam width (HPBW) of the second sub-band to be configured independently of the HPBW of the first sub-band. The signals from the first port and the second port may be combined at the radiating elements by diplexers.

In one example, the columns of radiating elements have a spacing of about one wavelength at a frequency corresponding to the first sub-band, and the first sub-band has a first half power beamwidth. The second power divider is selected such that a second half power beamwidth corresponding to the second sub-band is approximately equal to the first half power beamwidth. In another example, the first sub-band has a first half power beamwidth, and the second power divider is selected such that a second half power beamwidth corresponding to the second sub-band is unequal to the first half power beamwidth.

According to another aspect of the present invention, a multi-column antenna is provided including a plurality of columns of radiating elements, a plurality of first sub-band ports and a plurality of second sub-band ports. Each of the plurality of first sub-band ports is coupled to one of the plurality of columns of radiating elements by a first sub-band feed network. Each of the plurality of second sub-band ports is coupled to two of the plurality of columns of radiating elements by a second sub-band feed network including a power divider. The one of the first sub-band feed networks and a portion of one of the second sub-band feed networks may be coupled to a column of radiating elements by diplexers.

In one example, the columns of radiating elements having a spacing of about 0.5-0.65 wavelength at a first sub-band frequency. A pair of columns of radiating elements formed by one of the second sub-band radiating elements has an aperture having a spacing of about one wavelength at a second sub-band frequency. The antenna may further comprise four columns of radiating elements, the plurality of first sub-band ports comprise four 2600 MHZ sub-band ports, and the plurality of second sub-band ports comprise two 1900 MHz sub-band ports. In this example, the antenna comprises a 4×1 MIMO array optimized for the 2600 MHz sub-band and a 2×1 MIMO array optimized for the 1900 MHz sub-band, all operating on the same shared four columns of radiating elements.

BRIEF DESCRIPTION OF THE DRAWINGS

Illustrative embodiments of the present invention are described in detail below with reference to the following drawings, in which.

DETAILED DESCRIPTION

Figure 1:
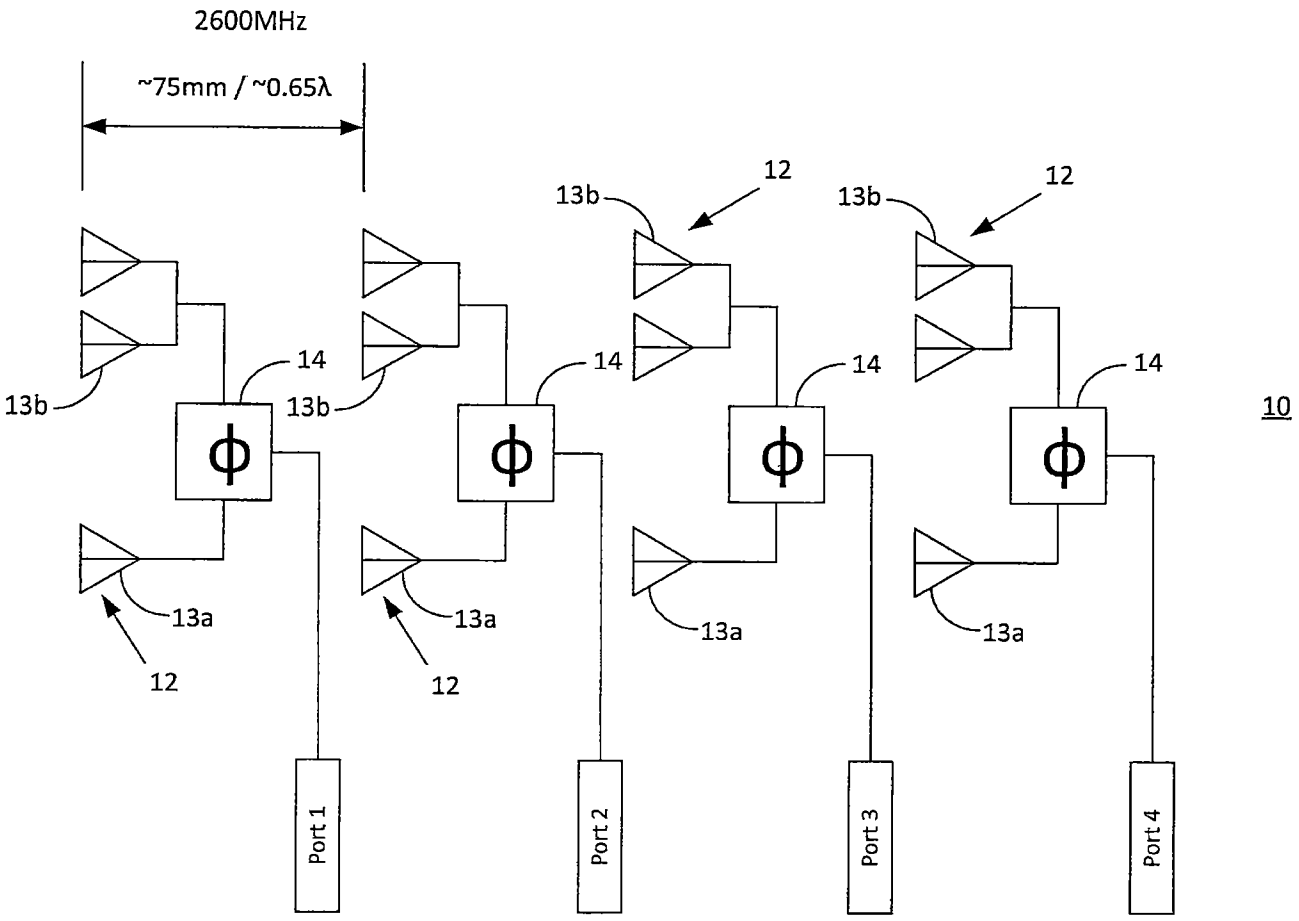
Fig. 1 (Prior Art)
FIG. 1 illustrates an example of a 4×1 MIMO antenna 10 that is optimized for TDD-LTE according to the prior art.

Referring to FIG. 1, an example of a 4×1 MIMO antenna 10 that is optimized for TDD-LTE is illustrated. The antenna includes four input ports, Port 1-Port 4, and four columns of radiators 12 spaced 0.5-0.65 wavelength apart. Each column 12 generates a nominal column HPBW of about 65 to 90 degrees in the 2490-2690 MHz band. Each column 12 has a feed network including an adjustable phase shifter 14. Each phase shifter 14 couples an input port to individual radiating elements 13*a* and/or sub arrays of two or more radiating elements 13*b* of a column 12. The phase shifter 14 varies the relative phasing of signals applied to individual radiating elements 13*a* and/or sub arrays of two or more radiating elements 13*b*. This variable phasing allows for electrically varying an angle of a radiated beam from perpendicular to the array of radiating elements.

Figure 2:
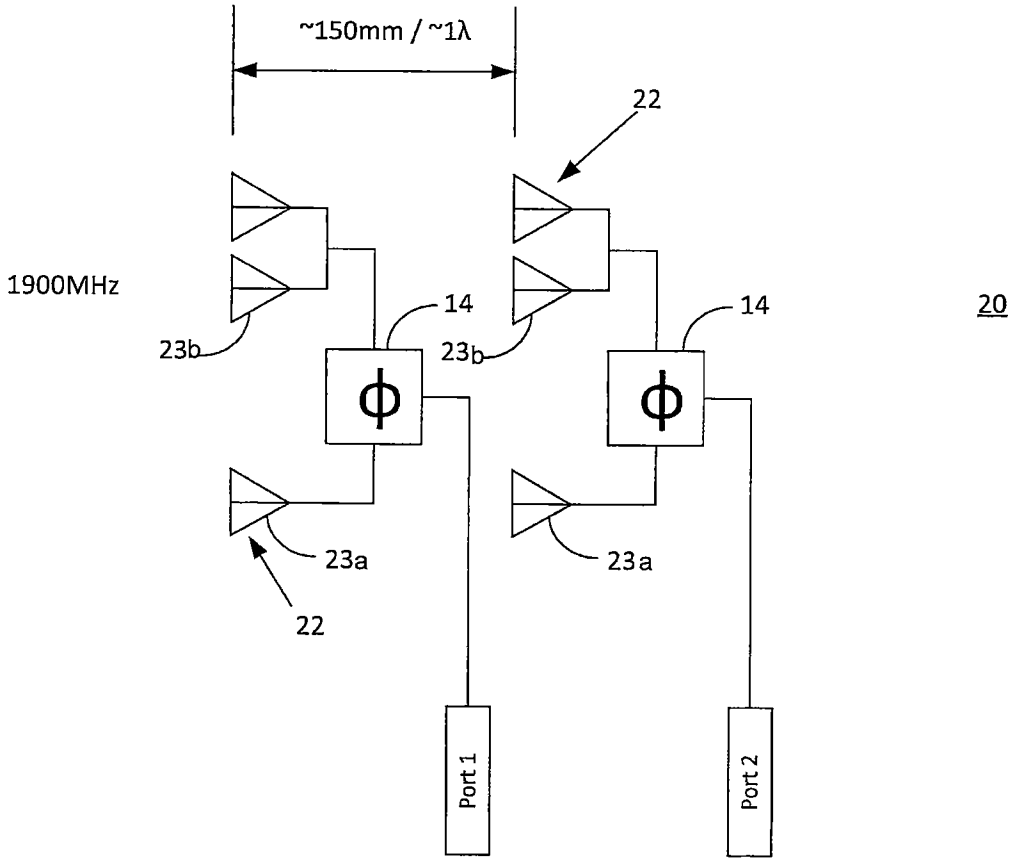
Fig. 2 (Prior Art)
FIG. 2 illustrates an example of a 2×1 MIMO antenna 20 optimized for FDD-LTE according to the prior art.

Referring to FIG. 2, an example of a 2×1 MIMO antenna 20 optimized for FDD-LTE is illustrated. The antenna includes two input ports, Port 1 and Port 2, and two columns of radiators 22 spaced one wavelength apart. Each column 22 generates a nominal column HPBW of 45-65 degrees in the 1710-2155 MHz band. As in the antenna of FIG. 1, each column 22 has a feed network including an adjustable phase shifter 14 that couples an input port to individual radiating elements 23*a* and/or sub arrays of two or more radiating elements 23*b* of a column 22. Due to these different requirements concerning number of MIMO ports and column spacing, 4×1 MIMO and 2×1 MIMO are typically implemented in separate antennas.

Figure 3:
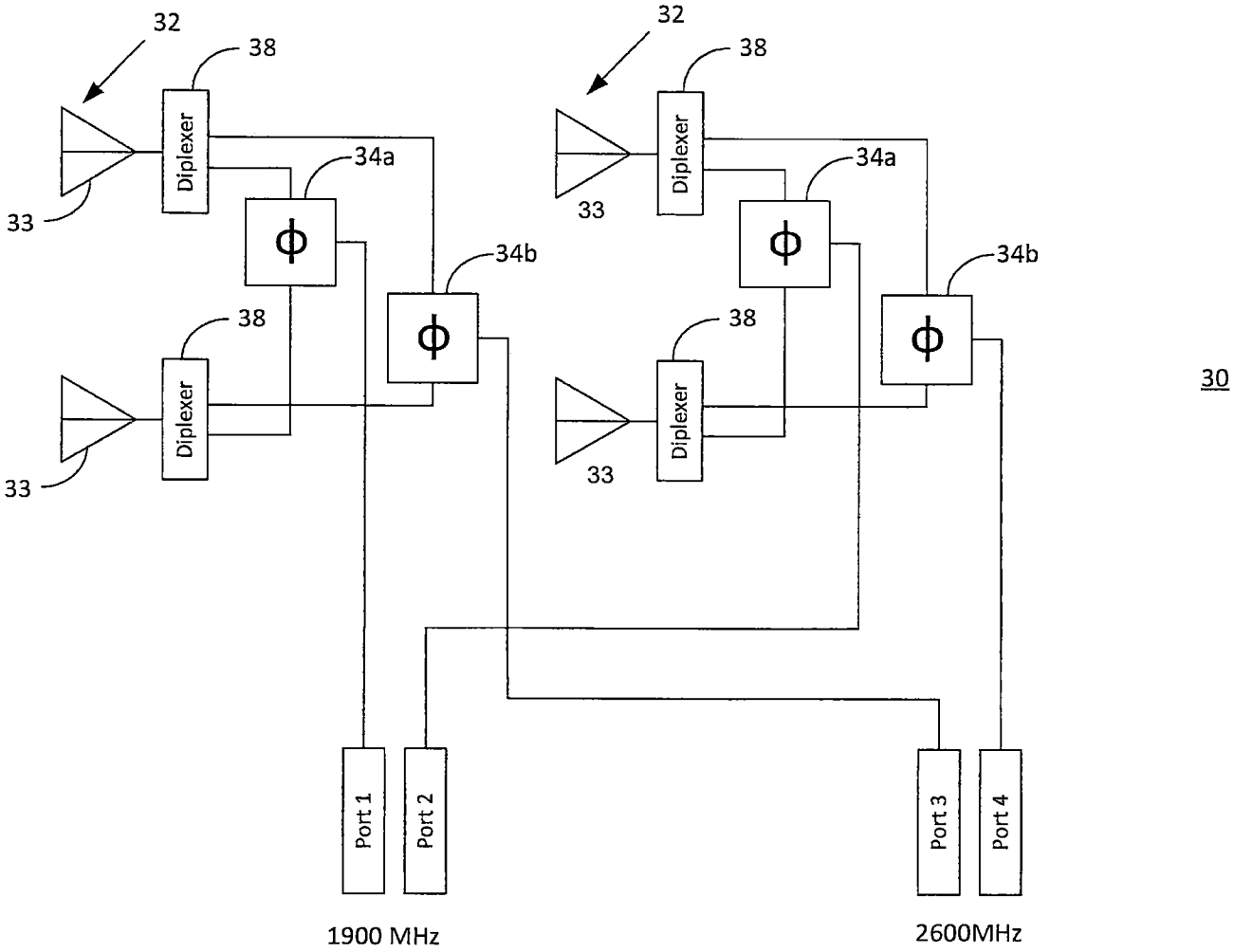
Fig. 3 (Prior Art)
FIG. 3 illustrates an example of an antenna 30 that combines sub-bands in common radiating element arrays according to the prior art.

Referring to FIG. 3, an example of an antenna 30 that combines sub-bands in common radiating element arrays is illustrated. Four ports and two columns 32 of radiating elements 33 are provided. Port 1 and Port 2 are provided for a first sub-band at 1900 MHz, and Port 3 and Port 4 are provided for a second sub-band at 2600 MHz. Radiating elements 33 are wideband radiating elements. Port 1 is coupled to a phase shifter 34*a* of a first column 32. Port 3 is coupled to a phase shifter 34*b* of the first column 32. Phase shifters 34*a* and 34*b* are coupled to the radiating elements 33 via multiplexer filters 38 (e.g. diplexers, triplexers). Typically, the feed networks include additional phase shifter outputs and radiating elements to better define the elevation beam pattern. See, e.g., U.S. Pat. No. 9,325,065, which is incorporated by reference herein. This sharing of radiating elements allows, for example, a single column of radiating elements to generate patterns with independent elevation downtilts for two different frequency bands.

FIG. 3 extends this concept of multiple columns of radiating elements. Port 2 is coupled to a phase shifter 34*a* of a second column 32. Port 4 is coupled to a phase shifter 34*b* of the second column 32. Phase shifters 34*a* and 34*b* are coupled to the radiating elements 33 via multiplexer filters 38.

However, a disadvantage of the example as shown in FIG. 3 is that if the number of columns and column spacing are optimized for one sub-band of LTE, it will not be optimized for the other sub-bands of LTE. For example, the antenna 30 of FIG. 3 may be optimized for the FDD-LTE 1900 MHz sub-band by spacing the first and second columns 32 apart at about one wavelength. However, this results in a sub-optimal configuration for the TDD-LTE sub-band. First, only two columns are provided, where four are desired. Additionally, the columns would be spaced apart at about 1.3 wavelength in the 2600 MHz sub-band, 0.65 wavelength is desired.

Figure 4:
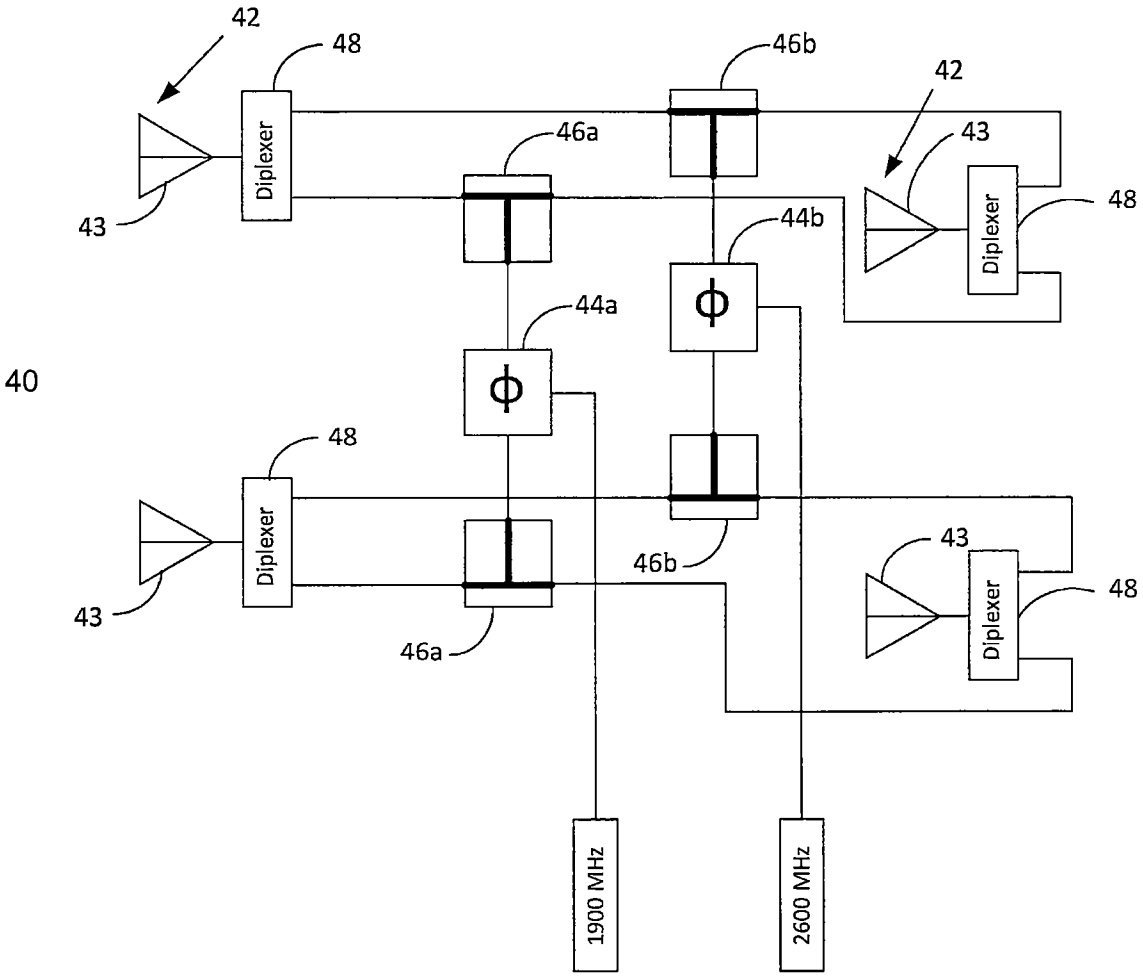
FIG. 4 illustrates a multiband antenna 40 according to a first aspect of the present invention.

A multiband antenna 40 according to a first aspect of the present invention is illustrated in FIG. 4. Two columns 42 of radiating elements 43 are provided. Two ports are provided. Port 1 is a 1900 MHz sub-band and Port 2 is a 2600 MHz sub-band.

Port 1 is coupled to phase shifter network 44*a*. The phases of the signals provided to each radiating element 43 in a column 42 (or subarray of radiating elements) may be varied to adjust electrical beam tilt. The outputs of the phase shifter network 44*a* are connected to the power dividers 46*a*. The power dividers 46*a* split the RF signal and provide the phase-adjusted signals to individual columns 42. Port 2 is coupled to phase shifter network 44*b*. The outputs of the phase shifter network 44*b* are connected to the power dividers 46*b*. The power dividers 46*b* split the RF signal and provide the phase-adjusted signals to individual columns 42. Diplexers 48 combine the signals from the Port 1 and Port 2 feed networks and couple the signals to the radiating elements 43.

The columns 42 may be spaced, for example, about 150 mm apart. This is one wavelength at 1900 MHz sub-band. In such an example, the power dividers 46*a* associated with the Port 1 feed network may be equal power dividers and have a power division ratio of 1:2. However, at 2600 MHz, a 150 mm spacing of the columns 42 would be about 1.3 wavelengths, narrowing the HPBW for the 2600 MHz sub-band. The HPBW may be restored by configuring power dividers 46*b* in the 2600 MHz feed network to be unequal power dividers, where the power division ratio is not 1:2. By configuring the power division ratios for power dividers 46*a*, 46*b* independently for each sub-band, the HPBW for the 1900 MHz sub-band can be configured to be the same as the HPBW for the 2600 MHz sub-band.

Alternatively, one may use this structure to intentionally generate different pattern beamwidths. For example, in an antenna with feed networks for two independent bands, one band could use power dividers configured to generate a HPBW of 45 degrees while the other band could use power dividers configured to generate a HPBW of 33 degrees.

Figure 5:
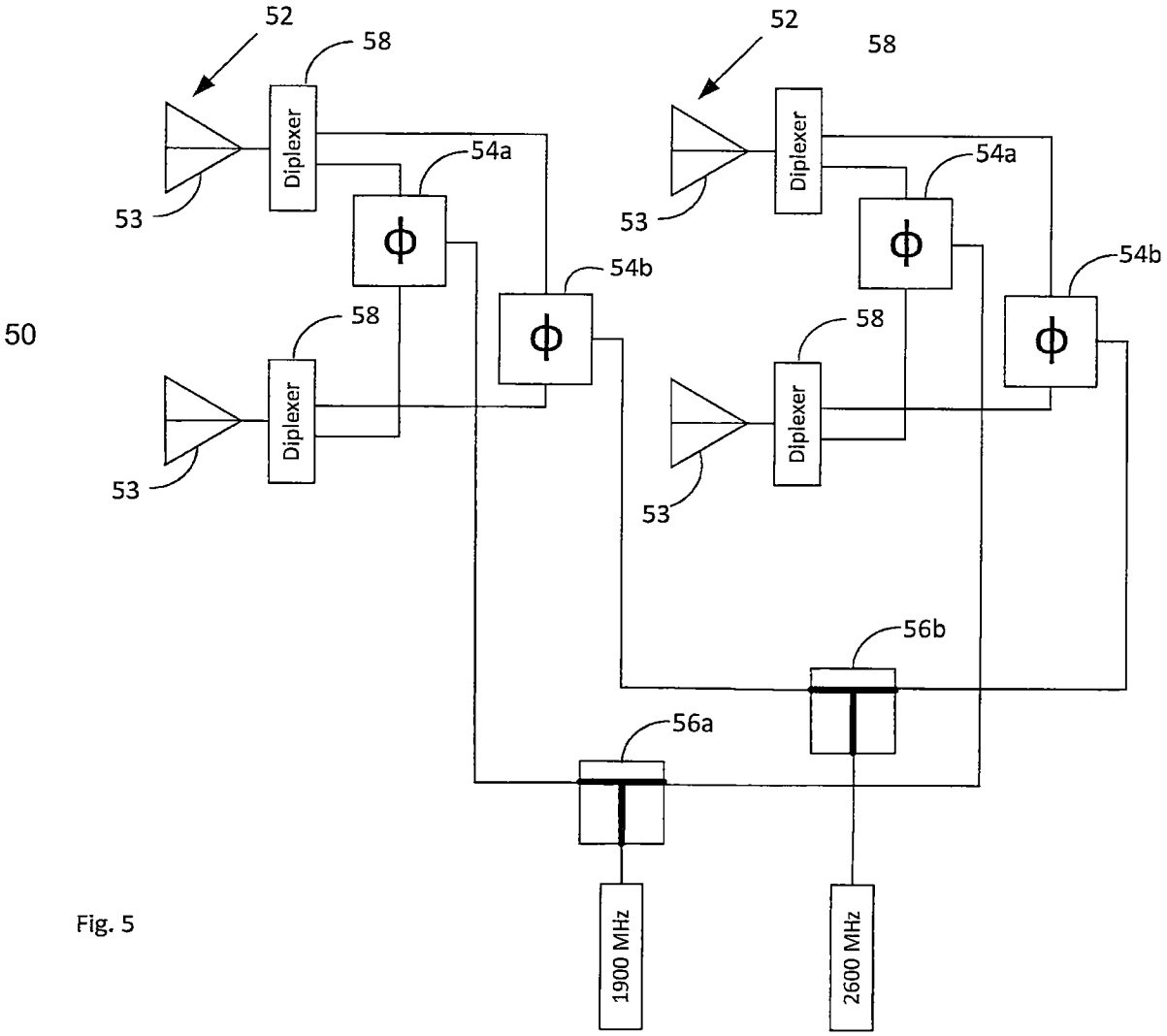
FIG. 5 illustrates an antenna 50 according to another aspect of the invention.

An antenna 50 according to another aspect of the invention is illustrated in FIG. 5. Two columns 52 of radiating elements 53 are provided. Two ports are provided. Port 1 is a 1900 MHz sub-band and Port 2 is a 2600 MHz sub-band.

Port 1 (1900 MHz sub-band) is coupled first to power divider 56*a*, which splits the signal so that it can be provided to feed networks of the two different columns 52. The outputs of the power divider 56*a* are coupled to a phase shifter network 54*a* in each column 52. Port 2 (2600 MHz sub-band) is coupled to second power divider 56*b*, which splits the signal so that it can be provided to feed networks of the two different columns 52. The outputs of the power divider 56*b* are coupled to a phase shifter network 54*b* in each column 52. Diplexers 58 combine the signals from the Port 1 and Port 2 feed networks and couple the signals to the radiating elements 53.

The power dividers 56*a*, 56*b*, may be independently configured for each sub-band as described above, such that the HPBW for the 1900 MHz sub-band is configured to be the same as the HPBW for the 2600 MHz sub-band. Additionally, as described above, one may use this structure to intentionally generate different pattern beamwidths for different sub-bands.

Figure 6:
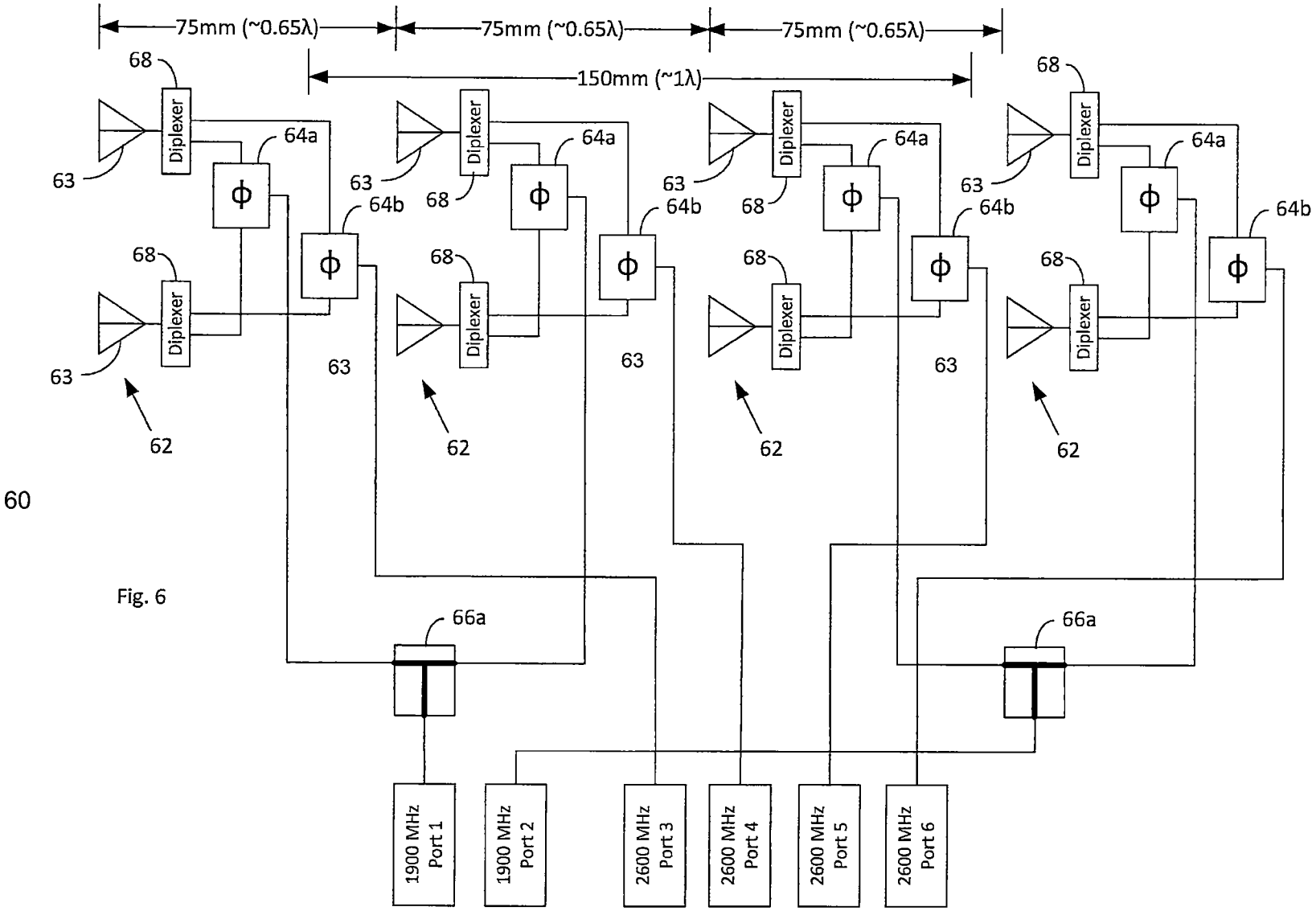
FIG. 6 illustrates an example of a MIMO antenna 60 that is optimized for TDD-LTE and FDD-LTE according to still another aspect of the invention.

Referring to FIG. 6, an example of a MIMO antenna 60 that is optimized for TDD-LTE and FDD-LTE is illustrated. The antenna 60 includes four 2600 MHz ports for TDD-LTE, 2600 MHZ Port 3-2600 MHz Port 6, and four columns 62 of radiators 63. The columns 62 are spaced 0.5-0.65 wavelength apart. This results in 4×1 MIMO, as desired for the 2600 MHz TDD-LTE band.

Each column 62 generates a nominal column HPBW of 65 or 90 degrees in the 2490-2690 MHz band. Each column 62 has a feed network including an adjustable phase shifter network 64 (64*a*, 64*b*). Each phase shifter network 64 couples a port to individual radiating elements 63 (and/or sub arrays of two or more radiating elements) of a column 62, via signal combining multiplexer filters 68 (e.g., diplexers). The phase shifter network 64 varies the relative phasing of signals applied to individual radiating elements 63 to achieve electrical downtilt.

The antenna 60 further includes two 1900 MHZ ports for FDD-LTE (1900 MHz Port 1-1900 MHz Port 2). For the 1900 MHz band, the four columns 62 are combined by power dividers 66 in pairs to form two arrays. The spacing between the center of the aperture of each of the pairs of columns 62 is 150 mm (about one wavelength), resulting in a 2×1 MIMO configuration as desired for the FDD-LTE 1900 MHz band. Advantageously, the power dividers 66 may be configured as unequal power dividers as described with respect to FIGS. 4 and 5 to control HPBW. For example, the HPBW can be adjusted between 40-90 degrees depending on the power divider used to combine the two adjacent columns. When unequal power dividers 66 are used, the greater amplitude of each power divider 66 is directed to an inner column 62 and a lower amplitude is directed to an outer column 62, so that the two inner columns 62 have higher amplitudes than the outer columns 62. In this way, 1900 MHz Port 2 has a mirror image power distribution compared to 1900 MHz Port 1. Alternatively, the columns may be combined in other ways, such as combining all 4 columns to generate a narrow HPBW of 20-35 degrees.

These possibilities will allow operators owning spectrum in multiple bands to be able to generate completely independent azimuth profiles for two different bands while using the exact same antenna, which will reduce site capital expense, operating expense leasing fees and tower loading while improving the aesthetic appearance of the site.

While the descriptions herein are made with reference to signal flow in the direction of transmission, the components exhibit reciprocity, and received signals move in the opposite direction. For example, the radiating elements also receive radio frequency energy, the power dividers also combine the received radio frequency energy, etc.

What is claimed is:

1. A multiband antenna, comprising:

a plurality of first ports that are configured to receive signals in a first frequency band;

a plurality of second ports that are configured to receive signals in a second frequency band; and a plurality of columns of radiators, each column of radiators coupled to one of the first ports and to one of the second ports;

wherein the multiband antenna is configured to transmit signals in the first frequency band in an Mx1 multi-input-multi-output ("MIMO") configuration and to transmit signals in the second frequency band in an Nx1 MIMO configuration, where N is greater than M.

2. The multiband antenna of claim 1, further comprising a plurality of power dividers, wherein each of the power dividers is coupled between a respective one of the first ports and a respective pair of the columns of radiators.

3. The multiband antenna of claim 2, wherein each of the power dividers is configured to unequally distribute power to the two columns of the respective pair of columns of radiators.

4. The multiband antenna of claim 3, wherein the multiband antenna includes a total of four columns of radiators that are coupled to the first and second ports, and wherein the multiband antenna includes a total of two power dividers that are coupled between the respective first ports and the respective pairs of the columns of radiators.

5. The multiband antenna of claim 4, wherein the multiband antenna includes first and second inner columns of radiators and first and second outer columns of radiators, and wherein a first of the power dividers is coupled to the first inner column of radiators and the first outer column of radiators and is not coupled to the second inner column of radiators and the second outer column of radiators, and wherein a second of the power dividers is coupled to the second inner column of radiators and the second outer column of radiators and is not coupled to the first inner column of radiators and the first outer column of radiators.

6. The multiband antenna of claim 5, wherein the first of the power dividers is configured to direct more energy to the first inner column of radiators than to the first outer column of radiators, and the second of the power dividers is configured to direct more energy to the second inner column of radiators than to the second outer column of radiators.

7. The multiband antenna of claim 1, wherein the plurality of columns of radiators comprises four columns of radiators, and wherein N=4 and M=2.

8. The multiband antenna of claim 1, wherein the columns of radiators are spaced apart by 0.5-0.65 wavelengths of a frequency of the second frequency band.

9. The multiband antenna of claim 1, wherein the first ports are configured for frequency division duplexing long term evolution (FDD-LTE) operation and the second ports are configured for time division duplexing long term evolution (TDD-LTE) operation.

10. A multiband antenna, comprising:

a plurality of first ports that are configured to receive signals in a first frequency band;

a plurality of second ports that are configured to receive signals in a second frequency band; and a plurality of columns of radiators, each column of radiators coupled to one of the first ports and to one of the second ports;

wherein each second port is coupled to a respective one of the columns of radiators, while each first port is coupled to at least two of the columns of radiators via a respective one of a plurality of power dividers.

11. The multiband antenna of claim 10, wherein each of the power dividers is configured to unequally divide the power of a respective signal input thereto.

12. The multiband antenna of claim 10, wherein the plurality of columns of radiators comprises a first column of radiators, a second column of radiators, a third column of radiators and a fourth column of radiators, and the plurality of power dividers comprises a first power divider that couples a first of the first ports to the first and second columns of radiators and a second power divider that couples a second of the first ports to the third and fourth columns of radiators.

13. The multiband antenna of claim 12, wherein the first and fourth columns of radiators are outer columns of radiators and the second and third outer columns of radiators are inner columns of radiators, and wherein the first of the power dividers is configured to direct more energy to the second column of radiators than to the first column of radiators, and the second of the power dividers is configured to direct more energy to the third column of radiators than to the fourth column of radiators.

14. The multiband antenna of claim 10, wherein the first ports are configured to operate in an Mx1 multi-input-multi-output ("MIMO") configuration and the second ports are configured to operate in an Nx1 MIMO configuration, where N is greater than M.

15. The multiband antenna of claim 14, wherein the plurality of columns of radiators comprises four columns of radiators, and wherein N=4 and M=2.

16. The multiband antenna of claim 10, wherein the columns of radiators are spaced apart by 0.5-0.65 wavelengths of a frequency of the second frequency band.

17. The multiband antenna of claim 10, further comprising a plurality of diplexers that are coupled between the radiators and the first ports and the second ports.

* * * * *